US005521444A

United States Patent [19]

Foreman

[11] Patent Number: 5,521,444

[45] Date of Patent: May 28, 1996

[54] APPARATUS FOR TRANSFERRING ELECTRICAL POWER FROM A STATIONARY DEVICE TO A ROTATING DEVICE WITHOUT THE USE OF BRUSHES OR CONTACTS

[75] Inventor: Donald S. Foreman, Fridley, Minn.

[73] Assignee: Honeywell Inc., Minneapolis, Minn.

[21] Appl. No.: 347,010

[22] Filed: Nov. 30, 1994

[51] Int. Cl.[6] ..... H01F 38/00

[52] U.S. Cl. ..... 307/104; 336/123

[58] Field of Search ..... 307/104, 17; 336/115, 336/122, 123; 363/16, 18, 21; 318/139; 290/5, 12, 15, 23, 29, 39, 49; 68/12.16

[56] References Cited

U.S. PATENT DOCUMENTS

| | | | |
|---|---|---|---|
| 3,535,618 | 10/1970 | Perrins | 336/123 |
| 3,758,845 | 9/1973 | MacKelvie et al. | 336/123 |
| 4,223,313 | 9/1980 | Chabrol | 336/123 |
| 4,336,486 | 6/1982 | Gorden et al. | 322/63 |
| 4,404,559 | 9/1983 | Renner | 336/123 |
| 4,635,044 | 1/1987 | South | 340/639 |
| 4,754,180 | 6/1988 | Kiedrowski | 336/123 |
| 5,180,923 | 1/1993 | Tyler | 290/40 B |
| 5,227,942 | 7/1993 | Rourk | 361/20 |
| 5,267,134 | 11/1993 | Banayan | 363/21 |

*Primary Examiner*—William M. Shoop, Jr.
*Assistant Examiner*—Richard T. Elms
*Attorney, Agent, or Firm*—William D. Lanyi

[57] ABSTRACT

A device for transferring electrical power from a stationary member to a rotatable member is provided by incorporating an air core transformer of which a first coil is rigidly attached to the stationary member and a second coil is rigidly attached to the rotatable member. A power converter is provided to convert input power from a first frequency to a second frequency. The first frequency can be that of a wall service within a family residence and the second frequency can be approximately 30 thousand hertz. The second frequency is provided to the electrical conductor of a first coil. The first and second coil of an air core transformer are used to transfer power across an air gap to the second coil. The transferred electrical power is then rectified to provide DC power to a plurality of electrical components that are rigidly attached to the rotatable member.

6 Claims, 6 Drawing Sheets

APPARATUS FOR TRANSFERRING ELECTRICAL POWER FROM A STATIONARY DEVICE TO A ROTATING DEVICE WITHOUT THE USE OF BRUSHES OR CONTACTS

BACKGROUND OF THE INVENTION

1. Field of the Invention

The present invention is generally related to a device for transferring power from a stationary device to a rotating device and, more particularly, to a power transferring arrangement that comprises primary and secondary coils of a transformer wherein one of the coils is rigidly attached to the stationary device and the other coil is rigidly attached to the rotating device and the coils are arranged in coaxial relation with each other.

2. Description of the Prior Art

Electrical power can be transferred from a stationary object to a moving object by using several known techniques. Carbon brushes are often used in various motor applications. In addition, the use of slip rings can provide electrical connection between stationary and moving objects. Rotating rectifiers, or brushless excitors, and rotating transformers can also be used to transfer electrical power between one object and another without requiring actual contact between stationary and moveable objects.

U.S. Pat. No. 5,227,942, which issued to Rourk on Jul. 13, 1993, discloses a structure for distributing failure induced transient currents in a multiphase electrical machine. It comprises an auxiliary stranded copper conductor that carries fault currents which are generated by a diode failure on the periphery of a brushless exciter diode wheel. The auxiliary conductor is constructed with a high frequency impedance that is lower than the adjacent diode wheel so that AC fault currents are diverted to the auxiliary conductor. The auxiliary conductor carries default currents to equalize both AC and DC flat currents among the fuse legs of the same phase. The auxiliary conductor can be circular and can be mounted between all of the diode fuse spaces at one end of the diode wheel and the diode wheel itself.

U.S. Pat. No. 5,180,923, which issued to Tyler on Jan. 19, 1993, describes a method and apparatus for downline load rejection sensing in a gas turbine control system. A speed signal representative of a turbine speed and a load signal representative of the turbine load are provided by the apparatus. The invention includes referencing devices for generating a delta speed reference signal and a delta load reference signal, derivative devices for determining the derivative of the speed signal and the load signal, comparators for comparing the speed derivative to the delta speed reference signal and for comparing the load derivative to the delta load reference signal and an indicator for indicating the occurrence of two events, namely, the first comparator determines that the speed derivative exceeds the delta speed reference signal and the second comparator determines that the load derivative exceeds the delta load reference signal. In one embodiment, a maximum turbine speed reference signal is provided and a third comparator compares a speed signal to the maximum turbine speed reference signal. An indicator provides a second indication on the occurrence of the first two events together with a third event, namely, a determination by the third comparator that the speed signal exceeds the maximum turbine speed signal.

U.S. Pat. No. 4,635,044, which issued to South on Jan. 6, 1987, discloses a failed fuse detector and detecting method for rotating electrical equipment. The apparatus is provided for remotely detecting the existence of a failed fuse of a brushless exciter rotor's rotating rectifier assembly. A conducting fuse produces a magnetic field which is sensed by elements of a stationary structure. A signal corresponding to the conducting status of each fuse is synchronized to the rotational speed of the brushless exciter rotor by means of a preselected oscillator frequency and the status of each individual fuse is retained and displayed until the next inspection of that fuse. Alarm circuitry enables automatic detection of a failed fuse and shut down in the event of multiple fuse failures. Since this method looks for the instance of current through each fuse, it operates in a fail-safe manner.

U.S. Pat. No. 4,336,486, which issued to Gorden et al on Jun. 22, 1982, describes a dynamoelectric machine with a brushless supplemental excitation system. Excitation power is supplied to a dynamoelectric machine by a main excitor having two field windings. A first field winding is driven by a pilot exciter which supplies base excitation for the main excitor. Forcing excitation is supplied by the second field winding which is driven by an external, supplemental power source. The main exciter can thus provide the appropriate excitation for both normal and transient operating conditions. In addition, by switching the controlled rectifier elements associated with the supplemental power source, the second field winding is also capable of providing fast de-excitation for the main exciter.

The four patents described above each relate to a brushless excitor, or rotating rectifier, that communicates electrical power between a stationary object and a rotating object. Each of the devices described in these patents depends upon, and makes extensive use of, the ferromagnetic structure which comprises iron that is associated with the winding of a coil structure. As will be described in greater detail below, the present invention does not use any ferromagnetic material in association with the winding for the purpose of providing a magnetic circuit between the primary and secondary windings.

SUMMARY OF THE INVENTION

A preferred embodiment of the present invention comprises a stationary member and a rotatable member. The rotatable member is attached to the stationary member so that complete rotation of the rotatable member is possible relative to the stationary member. A first coil is rigidly attached to the stationary member and a second coil is rigidly attached to the rotatable member. The first and second coils are disposed in coaxial relation with each other. The first and second coils may also be arranged in concentric relation with each other, but it is not necessary to dispose the first and second coils in this manner. The present invention further comprises a means for converting electrical power from an electrical current of a first frequency to an electrical current of a second frequency. The converting means is connected in electrical communication with the first coil. A preferred embodiment of the present invention further comprises a means for rectifying the electrical current of the second frequency to a direct current.

In a particularly preferred embodiment of the present invention, a plurality of electrical components are connected in electrical communication with the rectifying means and the plurality of electrical components are rigidly attached to the rotatable member. Although it is possible to utilize the present invention in association with many different arrangements of stationary and rotatable members, in a particularly preferred embodiment of the present invention the rotatable member is a drum of a machine used for washing articles. The plurality of electrical components can comprise a microprocessor, control components, actuators and sensors. The converting means of the present invention comprises a power oscillator and the first and second coils are arranged in concentric association with each other with a particularly preferred embodiment of the present invention which is associated with a washing machine.

In the description below, the first coil will be described as being larger than the second coil. However, it should be understood that the rotatable coil can be larger than the stationary coil in certain applications. The relative sizes of the first and second coils is not limiting to the present invention.

BRIEF DESCRIPTION OF THE DRAWINGS

The present invention will be more fully understood from a reading of the Description of the Preferred Embodiment in conjunction with the drawings, in which.

DESCRIPTION OF THE PREFERRED EMBODIMENT

Figure 1:
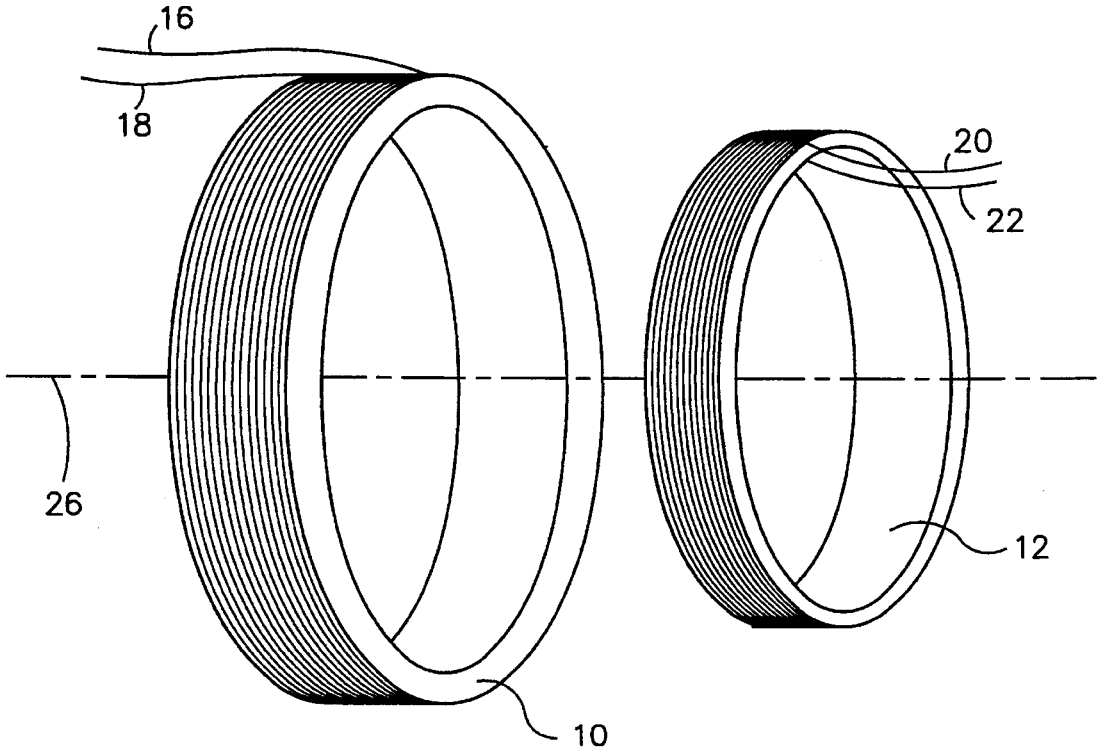
FIG. 1 is a schematic representation of the first and second coils of the present invention.

Throughout the Description of the Preferred Embodiment, like components will be identified by like reference numerals. FIG. 1 schematically illustrates a first coil 10 and a second coil 12. Each coil comprises a plurality of turns of an electrical conductor. In the application of the present invention, the coils are used as windings of a rotatable transformer. Although either of the two coils, 10 and 12, can be rotatable in the various embodiments of the present invention, a preferred embodiment will be described in terms of the first coil 10 being stationary and the second coil 12 being rotatable. The stationary coil 10 would be connected to a source of electrical power at a preselected frequency. Wires 16 and 18 provide this electrical connection. The source of electrical power to the first coil 10 can be any alternating current, but a preferred embodiment of the present invention connects wires 16 and 18 to an oscillator in order to provide a high frequency electrical current. The second coil 12 is connected to a load through the use of wires 20 and 22. The illustration in FIG. 1 shows the two coils in an coaxial association relative to axis 26, but in a nonconcentric relation with each other. In the preferred embodiment of the present invention, the coils are concentric with each other, but this is not a requirement.

Figure 2:
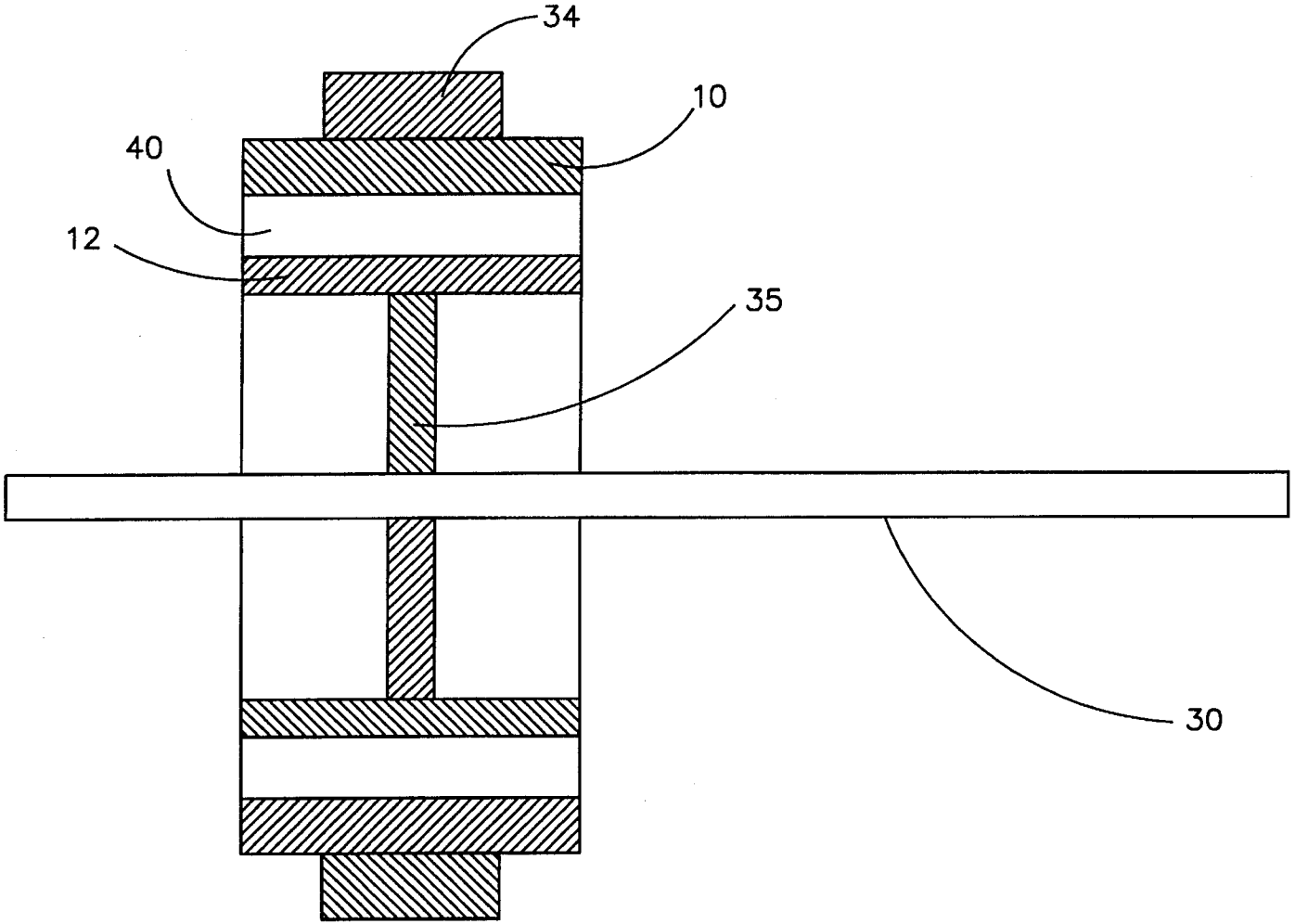
FIG. 2 is a side view of one embodiment of the present invention.
Figure 3:
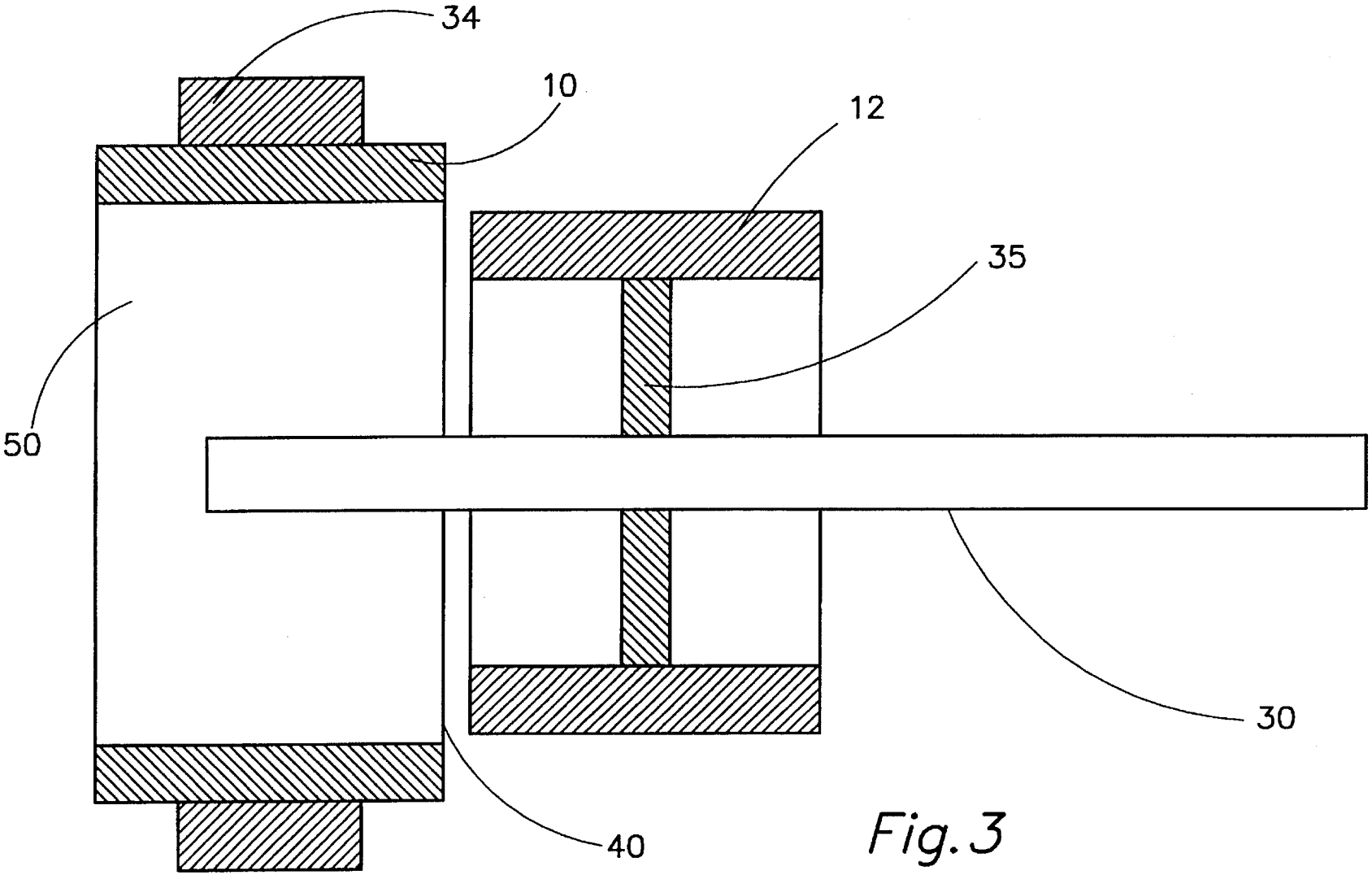
FIG. 3 is a side view of an alternative arrangement of the first and second coils.
Figure 6:
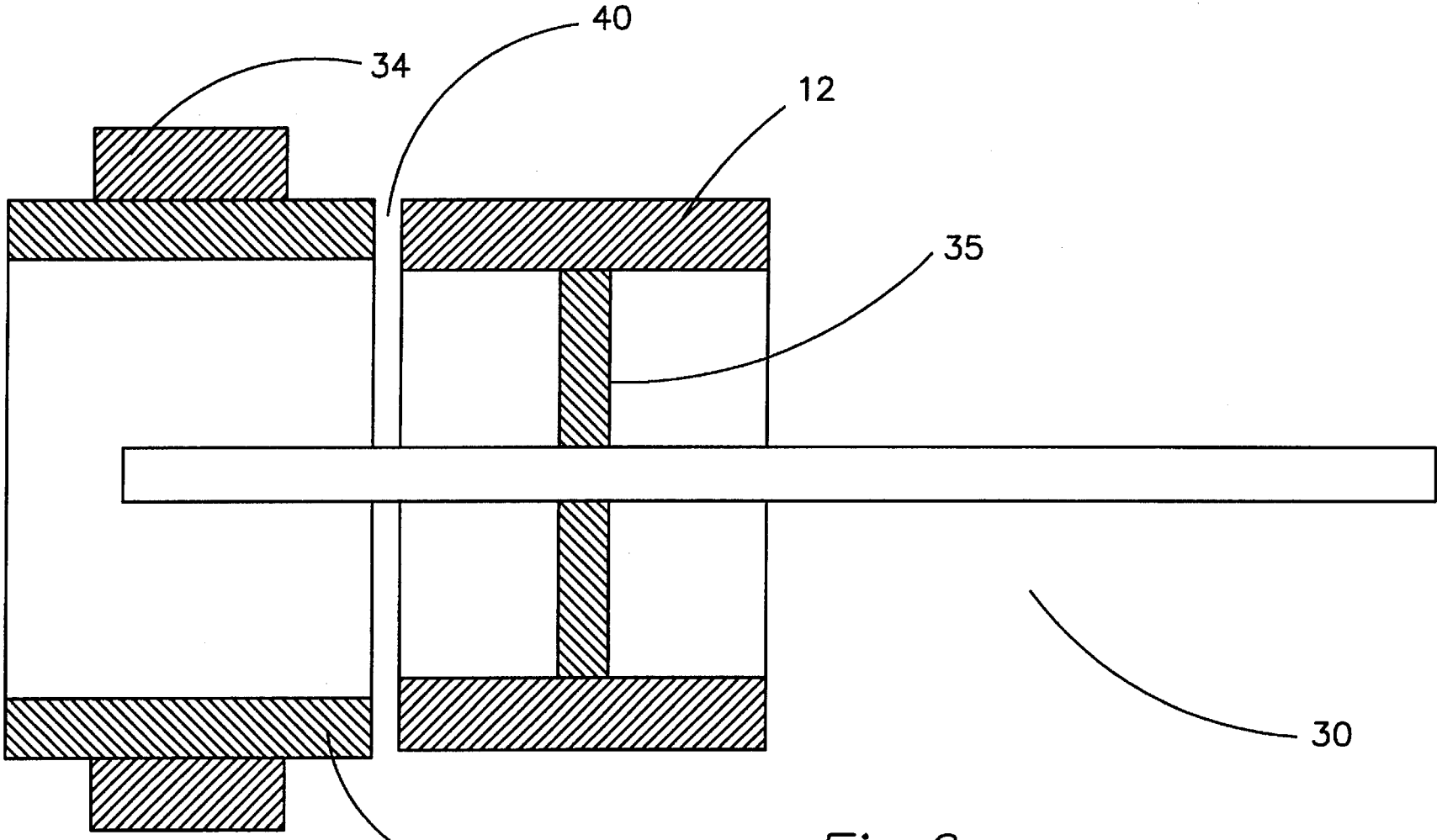
FIG. 6 is an alternative arrangement of the device shown in FIG. 3.

The following description of the present invention, in conjunction with FIGS. 2, 3, 4 and 6, refers to several embodiments of the present invention. In the Figures, the first and second coils, 10 and 12, are shown schematically. It should be understood that the representations of the first coil 10 and the second coil 12 in FIGS. 2, 3, 4 and 6 presume that the conductive winding within the coil structure is insulated to prevent the wire from contacting electrically conductive objects. In order to emphasize the fact that the actual wire used to form the winding of the first and second coils should not be disposed in electrical communication with either the rotatable member or the stationary structure used to support the first coil, insulative support structures are shown in these figures. For example, the first coil 10 is supported by an insulative member 34 and maintained in a stationary coaxial relationship with the shaft 30 and the second coil 12. In addition, an insulative support structure 35 is disposed between the rotatable shaft 30 and the second coil 12 to prevent electrical communication between the second coil 12 and the shaft. Since the precise shape and structure of the stationary support 34 and the rotating support 35 are not directly related to the present invention, they are represented by simplified schematic illustrations in the figures. The insulative stationary support 34 can be generally annular as shown in the figures or, alternatively, any other shape that is suitable to perform the function of maintaining the first coil 10 in coaxial relation with the second coil 12. The insulative support structure 35 can be any generally cylindrical insulative sleeve that is disposed between the first coil 12 and the rotatable shaft 30 in order to prevent electrical communication between the second coil 12 and the shaft. In FIG. 2, the first and second coils are disposed in both coaxial and concentric relation with each other. FIG. 3 shows an arrangement where the first and second coils are concentric but not coaxial and, in addition, the first and second coils are of significantly different diameters. FIG. 6 shows an alternative arrangement in which the first and second coils are disposed in concentric, but not coaxial, association with each other. In addition, the embodiment of the present invention shown in FIG. 6 utilizes first and second coils which are generally similar in diametric dimension. All of these illustrations are intended to show some of the possible arrangements that can be used in alternative embodiments of the present invention. The following discussion with discuss the figures in greater detail.

FIG. 2 shows a side sectional view of an adaptation of the present invention in conjunction with a rotatable shaft 30. The second coil 12 is rigidly attached to the shaft 30 for rotation therewith. A stationary device 34 is used to support the first winding 10 which is rigidly attached thereto. As shown in FIG. 2, the inside diameter of the first winding 10 is slightly larger than the outside diameter of the second winding 12 so that an airgap 40 exists therebetween. The combination of the first winding 10 and the second winding 12 forms a transformer with an air core. By providing alternating current to the electrical conductor of the first coil 10, electrical power can be transferred to the electrical conductor of the second coil 12. As such, the first coil 10 operates as a primary winding and the second coil 12 operates as a secondary winding.

FIG. 3 illustrates an alternative embodiment of the present invention where the first coil 10 and the second coil 12 are disposed in coaxial association with each other, but are not arranged concentrically. In other words, the second coil 12 is not disposed in the space identified by reference numeral 50. It should be understood that both embodiments which are shown in FIGS. 2 and 3 are within the scope of the present invention. It has been empirically determined that electrical power can be transferred from one winding to another even though the two windings are not in concentric association with each other. Although the arrangement shown in FIG. 2 provides certain advantages in the transfer of power from the first winding to the second winding, both arrangements are operable and can be used to provide power to components attached to a rotor 30.

Figure 4:
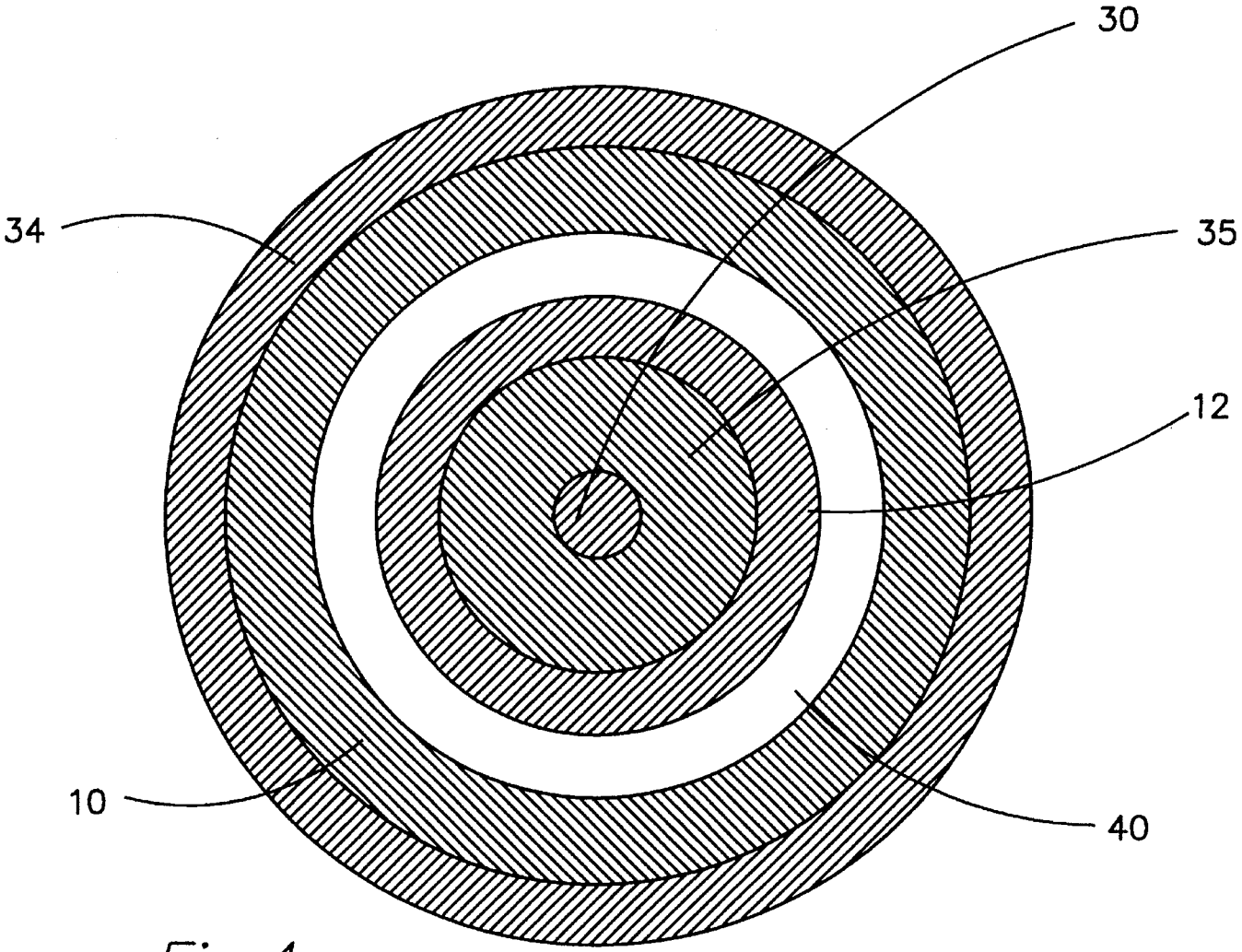
FIG. 4 is a sectional view showing the relative positions of the first and second coils of the present invention.

FIG. 4 shows a cross sectional view of the arrangement shown in FIG. 2. The first coil 10 is rigidly attached to the stationary device 34 and the second coil 12 is rigidly attached to the rotatable member 30. An airgap 40 exists between the outer diameter of the second coil and the inner diameter of the first coil. In one particularly preferred embodiment of the present invention, the rotor 30 is used to drive a rotatable drum of a machine for washing articles and the stationary device 34 is a support member within the washing machine.

With respect to FIGS. 1, 2, 3 and 4, it should clearly be understood that the stationary device 34 is not connected to the rotor 30 and, instead, merely supports the first winding 10 at a stationary position relative to the central axis of the shaft 30. In addition, the illustration of FIG. 1 represents a first coil 10 that is stationary and that is larger in diameter than the second coil 12. In other words, the outer dimension of the second coil 12 is less than the inner dimension of the first coil 10. This relative size results in an annular airgap between the first and second coils. This airgap is identified by reference numeral 40 in FIGS. 2 and 4. In FIGS. 2, 3 and 4, the second winding 12 is attached to the shaft 30 and rotates with it. The first winding 10 is attached to a stationary device 34 and remains stationary. The rotating members and the stationary members are associated together to define an airgap 40 between the first and second windings when they are at a common axial position as illustrated in FIG. 2. When they are at different axial positions, as illustrated in FIG. 3, the first winding 10 remains stationary because of its attachment to the stationary device 34 while the second winding 12 rotates because of its attachment to the shaft 30. This disconnection between the first and second windings is illustrated most clearly in FIG. 3.

In a preferred embodiment of the present invention, the primary coil is excited with a sinusoidal alternating current having a frequency above 20 thousand hertz. As will be described below, this can be provided at wires 16 and 18, as shown in FIG. 1, by a power oscillator. The power oscillator may comprise a single low cost power transistor with additional circuitry to comprise a self-excited oscillator circuit. Many alternative configurations are possible and are well known to those skilled in the art. These alternative oscillator circuits are well documented in the literature. By resonating the primary winding with a capacitor, acceptable efficiency and power transfer can be accomplished since the resultant resonant circuit is an integral part of the power oscillator. As an example, a primary winding with an inductance of 75 microHenries was provided by winding 20 turns of a conductor to form a coil having a four inch diameter and an axial length of approximately one half inch. A secondary winding having an inductance of 70 microHenries was provided by winding an electrical conductor of 19 turns to form a coil having a 4.38 inch diameter and an axial length of approximately one-half inch. In this empirical example, the secondary winding was larger than the primary winding and the coils were arranged in both coaxial and concentric association with each other. The resulting coefficient of coupling was 0.588. By using the design described immediately above, approximately 60 watts of power were transferred from a stationary primary winding to a rotating secondary winding by using a power source of 117 VRMS and converting that power to a second frequency of approximately 30000 hertz. Since the present invention uses an air core that has a coupling coefficient which is much smaller than 1.0, the output voltage on lines 20 and 22 do not correspond to a ratio of the voltage at lines 16 and 18 that is numerically equivalent to the ampere turns ratio of the primary and secondary winding.

It should be understood that conventional power transfer devices, such as transformers and brushless excitors, are usually designed for close coupling between primary and secondary windings. In the present invention, however, high efficiency of power transfer has been accomplished with the relatively loose coupling characteristics of air core transformers. Efficiency, in this context, is defined as the load power divided by the input power. It should also be understood that the specific methods used in conjunction with the present invention for rectification and regulation are not, in themselves, novel. Those methods are discussed herein for the purpose of more clearly describing a preferred embodiment of the present invention.

Figure 5:
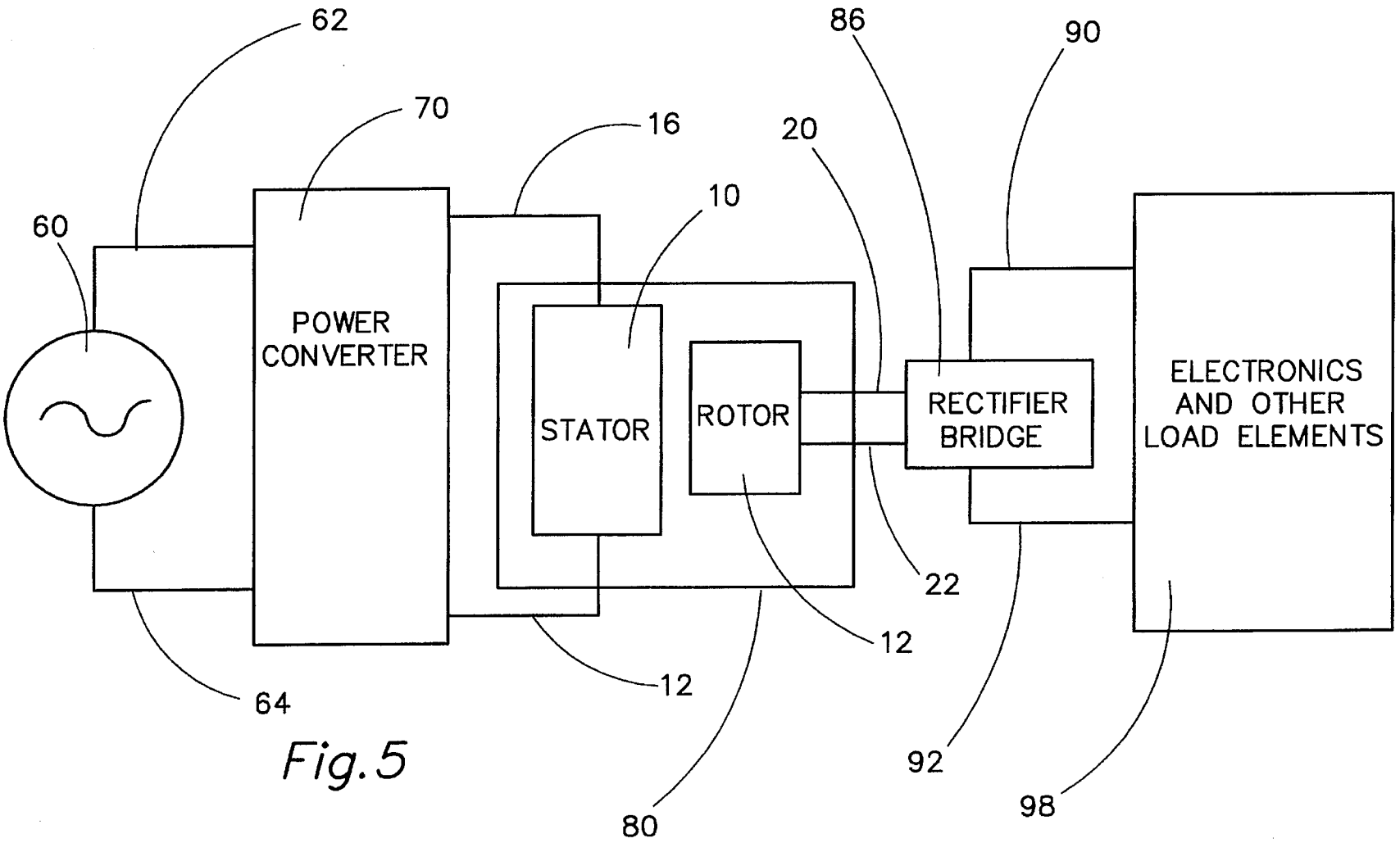
FIG. 5 is an electrical schematic diagram showing the components of the present invention in association with a power source and a plurality of electronics.

FIG. 5 illustrates an exemplary arrangement that schematically shows the interconnections between the various components of the present invention. A power source 60, such as a wall circuit of a family residence, is used to provide electrical power at a first frequency. In a typical application of the present invention, the first frequency is 60 hertz. This power is provided, on lines 62 and 64, to a power converter 70 which transforms the frequency from 60 hertz to 30 kilohertz on lines 16 and 18. This high frequency electrical power flows through the turns of the winding of the first coil 10. In FIG. 5, the first coil 10 is identified as the stator and the second coil 12 is identified as the rotor, but it should be clearly understood that these roles could be reversed in alternative embodiments of the present invention. Reference numeral 80 is used to identify a box that encloses the first and second coils. As such, reference numeral 80 identifies the air core transformer used to transfer power from a stationary member to a rotatable member. Wires 20 and 22 provide an output from the rotatable coil. This output is rectified by a bridge arrangement 86 to provide direct current on lines 90 and 92. Although not shown specifically in FIG. 5, it should be understood that the bridge arrangement 86 could be of various configurations. However, it is recommended that a full wave rectifier be used in conjunction with a regulator circuit. Since this technique is well known to those skilled in the art, it will not be described in detail. Although a full wave rectifying bridge is recommended for use in conjunction with the present invention, this type of rectifying circuit is not limiting to the present invention. Although a full wave bridge provides a relatively simple and economical design, the essence of the present invention is in the efficient transferring of power from a stationary member to a rotating member and is not limited by the specific means chosen for converting, regulating and managing the power.

With continued reference to FIG. 5, the box identified by reference numeral 98 represents a plurality of electrical components. The plurality of electrical components would typically comprise sensors, actuators, electrical control devices and a microprocessor. The arrangement shown in FIG. 5 provides 12 volt DC power that can be used to operate those devices. In this way, a rotating member can be provided with a plurality of devices that can help it dynamically change its characteristic in some way while the rotatable member is rotating relative to the stationary member. This procedure can provide DC power to operate the electrical components without requiring the provision of brushes or other contact methods to transfer power from a stationary source to a rotatable member. Although FIG. 5 is a simple schematic of the present invention, it illustrates the fundamental building blocks of a system which comprises the present invention. The bridge 86 would typically comprise a rectifying bridge and related power control electronics. The block identified by reference numeral 98 would typically comprise electronic circuits, actuators, and various other electrically driven equipment that is rigidly attached to the rotating member.

Although the present invention has been described with particular specificity and a preferred embodiment has been illustrated in detail, it should be understood that alternative embodiments of the present invention are within its scope. For example, the particular frequencies described above in conjunction with the preferred embodiment are not limiting. A wide range of input frequencies can be used along with the presence or absence of the power converter. In addition, several known techniques are available for providing DC power to the electrical components that are rigidly attached to the rotor. In addition, although the present invention has been particularly described in terms of its use in conjunction with a machine for washing articles, it should be understood that it could be used to transfer power from virtually any stationary component to any rotatable component.

The embodiments of the invention in which an exclusive property or right is claimed are defined as follows:

1. A power transfer device, comprising:

a stationary member;

a rotatable member attached to said stationary member;

a first coil rigidly attached to said stationary member; and a second coil rigidly attached to said rotatable member, said first and second coils being disposed in coaxial relation with each other to form an air core transformer for transferring electrical power from said first coil to said second coil;

means for converting electrical power from an electrical current of a first frequency to an electrical current of a second frequency, said converting means being connected in electrical communication with said first coil;

means for rectifying said electrical current of said second frequency to a direct current; and a plurality of electrical components connected in electrical communication with said rectifying means, said plurality of electrical components being rigidly attached to said rotatable member.

2. The device of claim 1, wherein:

said plurality of electrical components comprises a microprocessor.

3. The device of claim 1, wherein:

said converting means comprises a power oscillator.

4. The device of claim 1, wherein:

said second frequency is greater than 20,000 Hertz.

5. The device of claim 1, wherein:

said first and second coils are arranged in concentric association with each other.

6. The device of claim 1, wherein:

the outer diameter of said second coil is less than the inner diameter of said first coil.

* * * * *